United States Patent [19]

Juds et al.

[11] Patent Number: 4,763,132

[45] Date of Patent: Aug. 9, 1988

[54] RESILIENT ONE PIECE WAVEGUIDE HANGER INTERLOCKABLE WITH ANTENNA TOWER

[75] Inventors: Richard C. Juds, Dolton; John P. Morris, Lockport, both of Ill.

[73] Assignee: Andrew Corporation, Orland Park, Ill.

[21] Appl. No.: 83,895

[22] Filed: Aug. 6, 1987

Related U.S. Application Data

[63] Continuation of Ser. No. 674,558, Nov. 26, 1984, abandoned.

[51] Int. Cl.[4] ..... H01Q 1/16; H01Q 1/22

[52] U.S. Cl. ..... 343/890; 343/891; 333/248; 248/73; 248/74.1; 248/74.2

[58] Field of Search ..... 333/248, 254; 343/890–892, 874; 248/73, 74.1, 74.2, 74.3; 24/16 R, 457, 458; 138/106, 107

[56] References Cited

U.S. PATENT DOCUMENTS

| | | | |
|---|---|---|---|
| 2,397,680 | 4/1946 | Morehouse | 248/73 |
| 2,716,703 | 8/1955 | Kane | 343/890 X |
| 3,154,281 | 10/1964 | Frank | 248/74.2 X |
| 3,345,706 | 10/1967 | Stokes | 24/458 X |
| 3,346,863 | 10/1967 | Siebold | 343/892 X |
| 3,501,117 | 3/1970 | Soltysik | 248/73 X |
| 4,334,659 | 6/1982 | Yuda | 248/73 |
| 4,505,006 | 3/1985 | Andre | 248/74.3 X |
| 4,572,466 | 2/1986 | Yamaguchi et al. | 248/73 |

FOREIGN PATENT DOCUMENTS

| | | | |
|---|---|---|---|
| 1000677 | 11/1976 | Canada | 248/74.1 |
| 710034 | 9/1941 | Fed. Rep. of Germany | 248/73 |
| 2807119 | 8/1979 | Fed. Rep. of Germany | 248/74 A |
| 1062633 | 3/1967 | United Kingdom | 248/73 |

OTHER PUBLICATIONS

Payton, J. N. & Rhoades, R. H., "Cable Tie"; *Western Electric Technical Digest,* No. 39; Jul. 1975; p. 25.

*Primary Examiner*—Eugene R. LaRoche
*Assistant Examiner*—Benny Lee
*Attorney, Agent, or Firm*—Stephen G. Rudisill

[57] ABSTRACT

A hanger for attaching a length of waveguide of elliptical cross-section to a crossbar on an antenna tower. The hanger comprises a resiliently yieldable and generally U-shaped clip adapted to be slipped into straddling relation with the waveguide and simultaneously inserted into a hole in the crossbar with a snap fit.

2 Claims, 2 Drawing Sheets

RESILIENT ONE PIECE WAVEGUIDE HANGER INTERLOCKABLE WITH ANTENNA TOWER

This is a continuation of copending application Ser. No. 674,558 filed on 11/26/84 now abandoned.

BACKGROUND OF THE INVENTION

This invention relates generally to a hanger and, more particularly, to a hanger for supporting a length of waveguide of the type used, for example, as a transmission line in a microwave antenna system.

The invention has more specific reference to hangers for waveguide of elliptical cross-section and extending from transmitting or receiving equipment in an equipment shelter to an antenna mounted on a tall tower. A large number of hangers are required to support the waveguide beneath a horizontal waveguide bridge extending between the shelter and the base of the tower and to support the waveguide on the tower as the waveguide extends upwardly to the antenna. An even larger number of hangers are those instances where separate waveguides extend to several antennas on a single tower.

A typical hanger for elliptical waveguide comprises a generally U-shaped clip or clamp adapted to be attached to a support member on the bridge or the tower by a bolt extending through a hole in the support member and held in place by a nut and lock washer. After the hangers have been attached to the support members, the waveguide is strung along the bridge and up the tower and is clamped between the legs of each U-shaped hanger by tightening a clamping screw which extends between the legs. A considerable amount of installation time is required, first to attach the large number of hangers to the bridge and the tower and then to clamp the waveguide within the hangers. In addition, a large quantity of auxiliary hardware (i.e., screws, bolts, nuts and washers) is required along with the hangers themselves.

SUMMARY OF THE INVENTION

The general aim of the present invention is to provide a new and improved waveguide hanger which may be attached to the support member and clamped to the waveguide in a faster and easier manner than prior hangers and which may be attached and clamped without requiring any auxiliary hardware and without requiring the use of tools.

A related object of the invention is to provide a waveguide which may be simply snapped into an installed position on the support member and, as an incident thereto, automatically clamps the waveguide in such a manner as to securely hold the waveguide without deforming and degrading the waveguide.

A more detailed object is to achieve the foregoing by providing a hanger in the form of a resiliently yieldable and generally U-shaped clip adapted to be slipped into straddling relation with the waveguide and simultaneously assembled with the support member with a snap fit.

The invention also resides in the novel construction of the hanger permitting the hanger to be turned to a position to accommodate the waveguide during installation and thereafter restricting further turning of the hanger.

These and other objects and advantages of the invention will become more apparent from the following detailed description when taken in conjunction with the accompanying drawings.

DETAILED DESCRIPTION OF THE PREFERRED EMBODIMENT

Figures 1, 2, 3, 4:
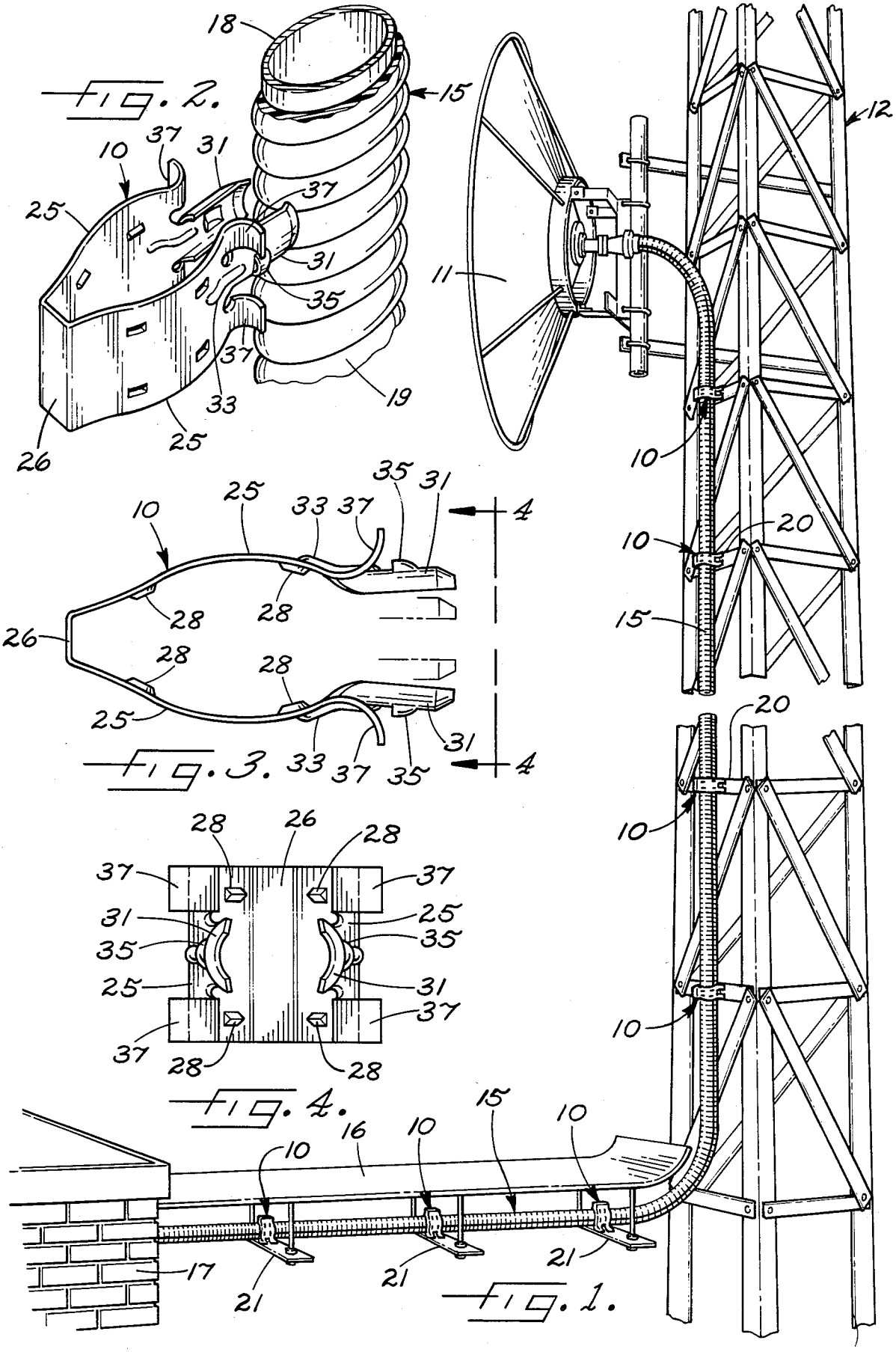
FIG. 1 is a perspective view showing a typical microwave antenna system equipped with new and improved hangers incorporating the unique features of the present invention.
FIG. 2 is a perspective view showing a hanger just prior to being slipped over the waveguide.
FIG. 3 is a top plan view of the hanger shown in FIG. 2.
FIG. 4 is an end view of the inner end of the hanger as taken along the line 4—4 of FIG. 3.

For purposes of illustration, the hanger 10 of the invention is shown in the drawings in conjunction with a microwave antenna system used for telecommunications. In general, the system comprises one or more microwave antennas 11 (FIG. 1) mounted on a tower 12 which may have a height in the neighborhood of 750 feet. A signal transmission line 15 is connected to each antenna and extends downwardly along the tower. Near the base of the tower, the transmission line extends horizontally beneath a waveguide bridge 16 to a shelter 17 which houses transmitting and/or receiving equipment. In some installations, the bridge also may be several feet long.

In the present instance, the signal transmission line 15 is an elliptical waveguide of the type sold by the assignee of the present invention under the trademark HELIAX. The waveguide 15 comprises corrugated copper tubing 18 (FIG. 2) formed with an elliptical cross-section and protected by a polyethylene jacket 19.

Hangers 10 are used to attach the elliptical waveguide 15 to support members or crossbars 20 (FIGS. 1 and 5) on the tower 12 at a maximum of four-foot intervals and with the longer axis of the ellipse extending perpendicular to the crossbars. In addition, the hangers are used to attach the waveguide at approximately the same intervals to horizontal support members 21 beneath the bridge 16. Thus, a large number of hangers must be installed to support the waveguide along its entire length. A system with a tall tower and several antennas may require several hundred hangers.

The present invention contemplates the provision of a relatively simple and low-cost hanger 10 which may be attached quickly and easily to the support member 20 or 21 with a simple snap-in action and without need of tools or auxiliary fasteners. As an incident to being snapped in place, the hanger moves into straddling relation with the waveguide 15 and then clamps the waveguide in such a manner as to hold the waveguide in place without deforming the waveguide and degrading the electrical characteristics thereof. Thus, both attachment of the hanger and clamping of the waveguide may be accomplished with a simple one-step operation so as to significantly reduce the installation time and to effect a considerable saving in labor required for the installation of the hangers and waveguide of each tower.

The hanger 10 which has been illustrated in detail in FIGS. 2 to 8 is a hanger which is used to attach the waveguide 15 to a crossbar 20 of the tower 12 and thus the hanger has been shown as extending horizontally outwardly from the crossbar. Identical hangers are used to attach the waveguide to the support members 21 on the bridge 16 but, in such a case, the hangers extend upwardly from the support members. For purposes of convenience, direction-indicating terms such as upper, lower, horizontal and vertical will be used in describing the horizontally extending hanger of FIGS. 2 to 8 and it should be understood that the vertically extending hangers are different only as a matter of orientation.

In the present instance, the hanger 10 is made from a single strip of resiliently yieldable material; preferably stainless steel having a thickness of about 0.035". The strip is bent generally in the shape of a U so as to form two transversely spaced and horizontally extending legs 25 and to form a bridge 26 extending between the outer end portions of the legs. Each leg is curved or bowed into a convex-concave shape. The opposing inboard sides of the two legs are concave and correspond generally in shape to the longer sides of the ellipse defined by the outer periphery of the waveguide 15. Four inwardly projecting and generally V-shaped teeth 28 (FIGS. 3, 5 and 8) are formed on the inboard side of each leg by inwardly depressing the outboard side of the leg. The teeth are located adjacent the corner portions of the leg and tend to bite into the polyethylene jacket 19 of the waveguide in the installed position of the hanger (see FIGS. 7 and 8). Thus, the teeth promote secure gripping of the waveguide by the legs 25.

The bridge 26 of the present hanger 10 is flat and planar and defines a resilient hinge connection between the legs 25. By virtue of the bridge and the resiliency of the legs, the legs may flex transversely apart and flex transversely toward one another from unstressed or relaxed positions located between the spread and contracted positions. When the spreading or contracting force is removed, the legs spring back toward the relaxed positions.

Figure 5:
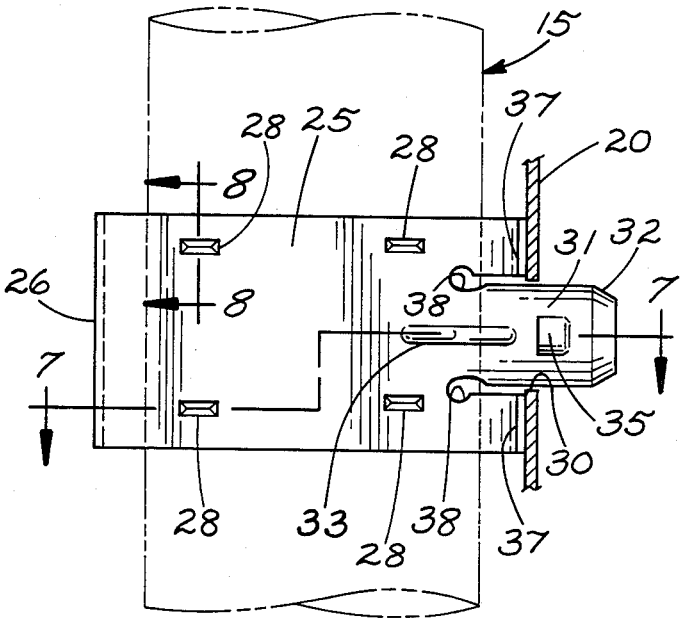
FIG. 5 is a side elevational view of the hanger illustrated in FIG. 3 and showing the hanger in an installed position.
Figure 6:
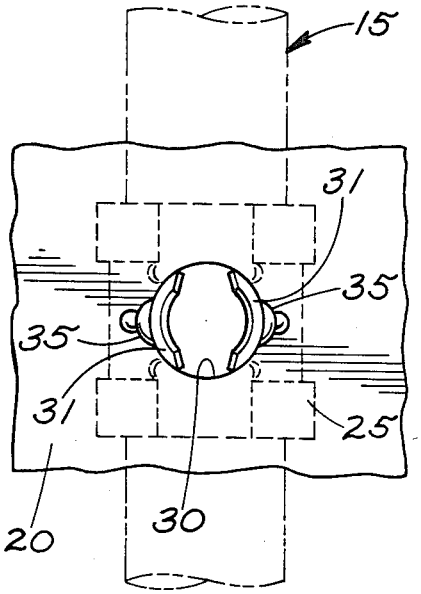
FIG. 6 is an elevational view looking into the right-hand side of the structure shown in FIG. 5.
Figure 7:
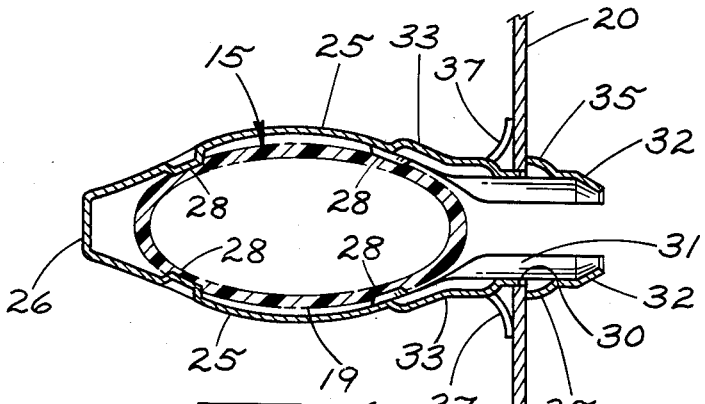
FIG. 7 is a fragmentary cross-section taken substantially along the line 7—7 of FIG. 5.
Figure 8:
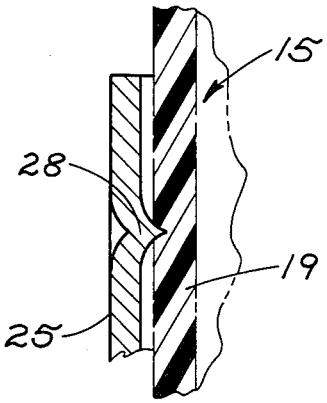
FIG. 8 is an enlarged fragmentary cross-section taken substantially along the line 7—7 of FIG. 5.

As shown in FIGS. 5 to 7, the inner end portion of the hanger 10 is adapted to be snapped into a circular hole 30 of predetermined diameter formed through the crossbar 20. For this purpose, finger-like prongs 31 are formed integrally with and project inwardly from the inner end portions of the legs 25 midway between the upper and lower edges thereof. Each prong is generally semi-circular in radial cross-section and its outboard side is curved on substantially the same radius as the hole 30. The outer end portions of the prongs are tapered inwardly as indicated at 32 to facilitate initial insertion of the prongs into the hole 30. A stiffening gusset 33 (FIGS. 3 and 5) extends horizontally across the junction between the outer end of each leg and the inner end portion of the respective prong to help keep the prong from flexing or bending relative to the leg.

Transversely extending detents 35 are formed on the outboard sides of the prongs 31 to hold the prongs against removal from the hole 30 once the prongs have been inserted in the hole. Each detent is a shear-formed bubble having an inclined outboard surface and having an outwardly facing shoulder located outwardly of the inclined surface.

The hanger 10 is completed by feet 37 (FIGS. 2 to 4) which engage the outer side of the crossbar 20 to restrict turning of the hanger once the hanger has been installed. Two feet are formed on the outer end of each leg 25 by bending the outer end portion of the leg transversely into a curved shape, the feet on each leg extending transversely away from the feet on the other leg. The feet 37 of each leg 25 are spaced above and below the prong 31 of the leg so that slots 38 appear between the feet and the prong when the hanger is viewed in side elevation as in FIG. 5.

When the spring metal of the hanger 10 is in a normal relaxed condition as shown in FIGS. 3 and 4, the two prongs 31 are spaced transversely from one another by a distance considerably greater than the diameter of the hole 30 in the crossbar 20 but somewhat less than the diameter along the minor axis of the ellipse defined by the waveguide 15. In addition, the maximum transverse dimension between the inboard sides of the legs 25 is somewhat greater than the minor diameter of the waveguide.

Installation of the hanger 10 takes places intially while the hanger is relaxed. Such installation is effected by moving the hanger horizontally and inwardly toward the waveguide 15 in a direction extending parallel to the major axis of the waveguide (see FIG. 2). Once the prongs 31 start engaging the waveguide, the waveguide cams against the prongs and causes the prongs and the legs 25 to spread so that the prongs may slip past the minor axis diameter of the waveguide. After being moved past the waveguide, the prongs spring back to their normal positions.

As the legs 25 are slipped into full straddling relation with the waveguide 15, the legs are manually squeezed together to close the prongs 31 to an effective diameter approximating the diameter of the hole 30 and allow insertion of the prongs into the hole. During such insertion, both the tapered surfaces 32 of the prongs and the inclined surfaces of the detents 35 may cam against the edge of the hole to squeeze the prongs toward one another as they pass into the hole. Once the detents clear the inner side of the crossbar 20, the squeezing pressure on the legs 25 is relaxed to allow the prongs 31 to spread against the resiliency of the material until the spreading is stopped by engagement of the arcuate outboard surfaces of the prongs with the circular edge of the hole.

In the installed position of the hanger 10, the shoulders of the detents 35 engage the inner surface of the crossbar 20 adjacent the hole 30 and prevent the prongs from being withdrawn from the hole (see FIG. 7). In addition, the prongs are virtually locked in the hole as a result of the waveguide 15 acting as a wedge and camming against the inner end portions of the legs 25 to force the prongs to spread and thereby keep the detents in engagement with the inner side of the crossbar. Inward shifting of the hanger is prevented by virtue of the four feet 37 engaging the outer side of the crossbar 20. In addition, such engagement prevents the hanger from rocking either upwardly and downwardly or from side-to-side. It should be noted, however, that the hanger is capable of rotating about the axis of the hole 30 prior to the time the prongs 31 fully enter the hole and thus, during the installation, the hanger may be turned as necessary to accommodate any deviation in the orientation of the waveguide.

Once the hanger 10 is fully installed, the legs 25 closely embrace and grip the waveguide 15 to prevent any shifting of the waveguide in the hanger (see FIG. 7). The gripping is enhanced by the teeth 28. Although the hanger clamps the waveguide to prevent shifting thereof, the clamping force is not sufficiently great to deform the waveguide and degrade its electrical characteristics.

From the foregoing, it will be apparent that the present invention brings to the art a new and simplified hanger 10 which may be installed on the waveguide 15 and, at the same time, attached to the crossbar 20 (or the support member 21). The one-step installation may be effected without the use of tools or fasteners and results in a significant saving of time during the installation of a large number of hangers. Moreover, the clamping force which is exerted on the waveguide is predetermined by the hanger itself and thus there is no danger of the installer undertightening or overtightening clamping screws.

We claim:

1. In a system for guiding microwaves from a source apparatus to a destination apparatus, the combination of:

an elongated microwave waveguide of substantially elliptical transverse cross-section, said waveguide comprising a corrugated tube of conductive metal surrounded by a protective exterior jacket, said waveguide connecting said source apparatus and said destination apparatus at different heights with a portion of said waveguide positioned vertically and another portion of said waveguide positioned horizontally;

support members having inner and outer sides and having at least one hole therein, and a multiplicity of single-piece hangers for attaching said waveguide to said support members, each of said hangers comprising:

A. a single strip of resiliently yieldable metal bent generally into the shape of a U so as to form first and second legs, each leg having inner and outer end portions, and also to form a substantially flat bridge portion extending between and interconnecting the outer end portions of said legs, B. said bridge portion supporting said legs in normally relaxed positions with said inner end portions opposite each other and spaced apart from one another in a direction extending transversely of said waveguide, C. the resiliency of said strip and said bridge portion permitting said legs to flex transversely apart and to flex transversely toward one another from relaxed positions and permitting said legs to spring back toward said relaxed positions, said legs being flexed apart upon being slipped inwardly onto said waveguide and thereafter springing into straddling relation with the waveguide, D. each of said legs having inboard and outboard sides, the inboard sides of said legs being concave and corresponding substantially in shape to the long sides of the ellipse defined by the outer periphery of the waveguide whereby the legs closely embrace the waveguide when the legs are in the straddling relation with the waveguide, E. a plurality of teeth in said inboard sides of said legs and extending inwardly to bite into said protective jacket of said waveguide and positively grip said waveguide to retain said vertical portion of said waveguide within said hangers.

F. a pair of transversely spaced prongs integral with and projecting inwardly from the inner end portions of said legs, each of said prongs having inboard and outboard sides and being generally semicircular in radial cross-section and having an arcuate outboard side curved on substantially the same radius as said hole, said prongs being flexed toward one another upon being inserted into said hole and thereafter springing apart so that said curved outboard sides of said prongs are pressed into tight engagement with the corresponding curved edge of said hole, G. transversely projecting detents integral with the outboard sides of said prongs and engageable with the inner side of said support member adjacent the edge of said hole to prevent removal of said prongs from said hole, H. said waveguide camming against the inner end portions of said legs to positively force said prongs into engagement with the edge of said opening and thereby prevent said detents from slipping outwardly past the inner side of said support member, and I. feet integral with the inner end portions of said legs and engageable with the outer side of said support member to restrict inward shifting, rocking upwardly and downwardly or side-to-side movement of said hanger, there being two feet on each leg with the prong of each leg being located between the feet on such leg, all of said feet extending transversely with the feet on one leg extending transversely opposite of the feet on the other leg.

2. In a ground station for microwave communication equipment, the combination of:

an antenna for transmission and reception of microwaves, a microwave transmission and reception equipment tower for elevating the antenna into alignment with the microwave path, housing facility for housing said microwave equipment, a bridge between said tower and said housing, an elongated microwave waveguide of substantially elliptical traverse cross-section, said waveguide comprising a corrugated tube of conductive metal surrounded by a protective exterior jacket; said waveguide connecting said antenna to said housing facility, where said antenna and said housing facility are at different heights, with a portion of said waveguide positioned vertically and the portion of said waveguide positioned horizontally;

supporting members having inner and outer sides and having at least one hole therein, said support members being attached to said tower and to said bridge, and a multiplicity of single-piece hangers for attaching said waveguide to said support members, each of said hangers comprising:

A. a single strip of resiliently yieldable metal bent generally into the shape of a U so as to form first and second legs, each leg having inner and outer end portions, and also to form a substantially flat bridge portion extending between and interconnecting the outer end portions of said legs, B. said bridge portion supporting said legs in normally relaxed positions with said inner end portions opposite each other and spaced apart from one another in a direction extending transversely of said waveguide, C. the resiliently of said strip and said bridge portion permitting said legs to flex transversely apart and to flex transversely toward one another from relaxed positions and permitting said legs to spring back toward said relaxed positions, said legs being flexed apart upon being slipped inwardly onto said waveguide and thereafter springing into straddling relation with the waveguide, D. each of said legs having inboard and outboard sides, the inboard sides of said legs being concave and corresponding substantially in shape to the long sides of the ellipse defined by the outer periphery of the waveguide whereby the legs closely embrace the waveguide when the legs are in the straddling relation with the waveguide, E. a plurality of teeth in said inboard side of said legs and extending inwardly to bite into said protective jacket of said waveguide and positively grip said waveguide to retain said vertical position of said waveguide within said hangers, F. a pair of transversely spaced prongs integral with and projecting inwardly from the inner end portions of said legs, each of said prongs having inboard and outboard sides and being generally semicircular in radial cross-section and having an arcuate outboard side curved on substantially the same radius as said hole, said prongs being flexed toward one another upon being inserted into said hole and thereafter springing apart so that said curved outboard sides of said prongs are pressed into tight engagement with the corresponding curved edge of said hole, G. transversely projecting detents integral with the outboard sides of said prongs and engageable with the inner side of said support member adjacent the edge of said hole to prevent removal of said prongs from said hole, H. said waveguide camming against the inner end portions of said legs to positively force said prongs into engagement with the edge of said opening and thereby prevent said detents from slipping outwardly past the inner side of said support member, and I. feet integral with the inner end portions of said legs and engageable with the outer side of said support member to restrict inward shifting, rocking upwardly and downwardly or side-to-side movement of said hanger, there being two feet on each leg with the prong of said leg being located between the feet on such leg, all of said feet extending transversely with the feet on one leg extending transversely opposite of the feet on the other leg.

* * * * *